US005216763A

United States Patent [19]

Grenier

[11] Patent Number: 5,216,763

[45] Date of Patent: Jun. 8, 1993

[54] PORTABLE SHOWER APPARATUS

[76] Inventor: Francis E. Grenier, 117 Michli Rd., Madison, Ala. 35758

[21] Appl. No.: 907,818

[22] Filed: Jul. 2, 1992

[51] Int. Cl.[5] ..... A61H 33/06; A47K 3/23

[52] U.S. Cl. ..... 4/527; 4/599; 4/601; 4/900

[58] Field of Search ..... 4/526, 527, 534, 596, 4/599, 600, 601, 612, 614, 615, 900

[56] References Cited

U.S. PATENT DOCUMENTS

| | | | |
|---|---|---|---|
| 477,515 | 6/1892 | Cox et al. | 4/599 |
| 569,808 | 10/1896 | Wyckoff | 4/527 X |
| 655,956 | 8/1900 | Cahoon | 4/527 |
| 833,527 | 10/1906 | Jackson | 4/601 X |
| 1,450,218 | 4/1923 | Nenoff | 4/599 |
| 2,539,710 | 1/1951 | Sziklay | 4/527 |
| 2,757,384 | 8/1956 | Slater | 4/601 |
| 3,501,213 | 3/1970 | Trexler | 4/900 X |
| 3,629,875 | 12/1971 | Dow et al. | 4/599 |
| 3,925,828 | 12/1975 | Kim | 4/599 |
| 4,675,923 | 6/1987 | Ashley | 4/599 |

FOREIGN PATENT DOCUMENTS

| | | | |
|---|---|---|---|
| 2513871 | 4/1983 | France | 4/601 |
| 2179549 | 3/1987 | United Kingdom | 4/599 |
| 8704059 | 7/1987 | World Int. Prop. O. | 4/612 |

*Primary Examiner*—Henry J. Recla
*Assistant Examiner*—Robert M. Fetsuga
*Attorney, Agent, or Firm*—John C. Garvin, Jr.

[57] ABSTRACT

A multipurpose, collapsible, shower apparatus for use almost anywhere but especially adapted for use in places somewhat remote from civilization such as recreational vehicles, campers, the outdoors, space vehicles and the like where there may be a limited amount of water or other liquid. The collapsible shower apparatus includes a curtain assembly having an inner wall, an outer wall and a porous element for separating the inner and outer walls; a series of spaced hollow hoops connected by one or more sets of hollow tubes (manifolds); one or more nozzles connected to and in communication with at least one of the hollow hoops; a source of fluid under pressure in communication with at least one of the hollow hoops; and a suction pump for withdrawing fluid from the interior of the curtain assembly.

20 Claims, 5 Drawing Sheets

PORTABLE SHOWER APPARATUS

ORIGIN OF THE INVENTION

The invention described herein was made in the performance of work under NASA Contract No. NAS8-50000 and is subject to the provisions of Section 305 of the National Aeronautics and Space Act of 1958 (42 U.S.C. 2457).

FIELD OF THE INVENTION

The present invention relates generally to a shower apparatus for use as a conventional bathing facility, for use for portable bathing by campers, for use as a bathing facility for decontamination purposes, and for use for medical treatment purposes. More particularly, this invention relates to a multipurpose shower apparatus having a structure which is portable, easily transportable, useable almost anywhere, but especially adapted for use in places somewhat remote from civilization such as use in space vehicles, recreational vehicles, ships, the outdoors and the like. Still more particularly, this invention relates to a multipurpose, collapsible, shower apparatus having structure which is portable, light weight, easily transportable, and especially adapted to use a much lesser amount of water or other liquid since it dispenses a fog or mist in lieu of a steady stream of water or other liquid.

BACKGROUND OF THE INVENTION

The prior art abounds with portable shower units for use for bathing and decontamination purposes. Most of prior art shower units include a single nozzle for dispensing a steady stream of water for bathing purposes; however, many of the prior art shower apparatuses include a plurality of nozzles for dispensing a steady stream of water for bathing purposes. U.S. Pat. Nos. 2,852,784, 3,629,875, 3,925,828, and 4,413,363 are illustrative of portable prior art shower apparatuses having a single nozzle for dispensing a steady stream of water for bathing purposes. U.S. Pat. Nos. 1,065,265, 2,336,402 and 4,554,690 are illustrative of portable shower apparatuses having a plurality of nozzles for dispensing steady streams of water for bathing purposes. U.S. Pat. Nos. 4,675,923 and 4,777,675 are illustrative of portable shower apparatuses having a single nozzle for dispensing a steady stream of water for decontamination purposes.

These prior art shower units, while somewhat portable, have several drawbacks or disadvantages. The principal disadvantage of these prior art shower units is due to the fact that they require a large amount of water since they dispense one or more steady streams of flowing water. Another principal disadvantage of these prior art shower unit resides in the fact that they are intended for use for a single function, namely, the function of bathing. Still another principal disadvantage of most of the prior art shower units resides in their rigid, non-collapsible, structure which precludes the ready and easy movement of the shower unit from one location to another.

DESCRIPTION OF THE PREFERRED EMBODIMENTS

Figure 1:
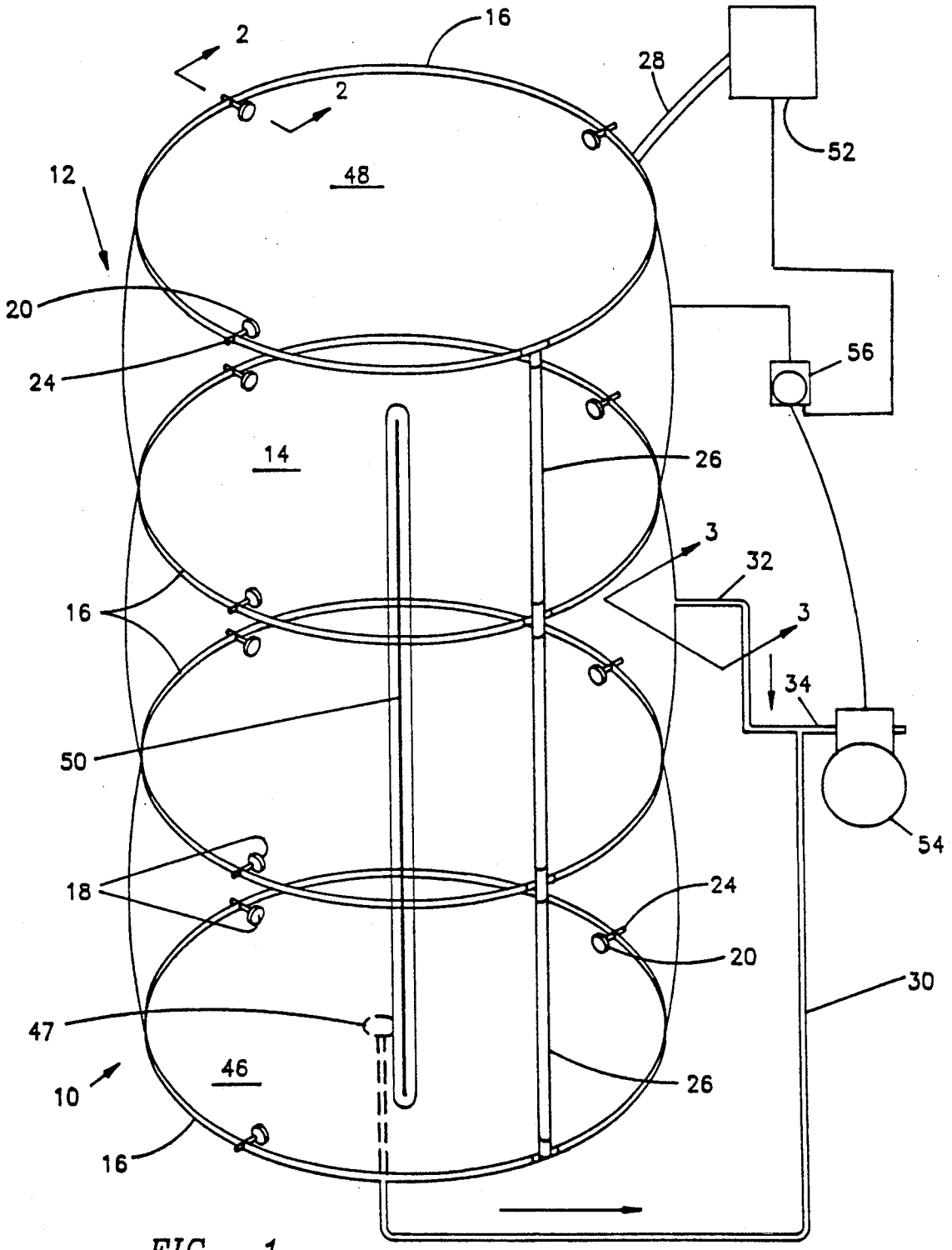
FIG. 1 is a perspective view of a first embodiment of the portable shower apparatus of the present invention in an upright, extended, condition, but not showing several elements for clarity purposes.
Figure 7:
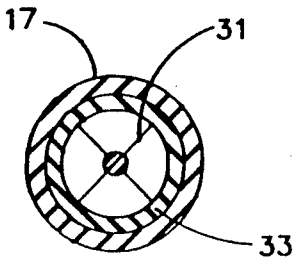
FIG. 7 is a sectional view along line 7—7 of FIG. 2.

Referring now to FIGS. 1-4 and 7 of the drawings which depict a first embodiment of the invention, reference numeral 10 designates the portable shower apparatus. The portable shower apparatus 10 is depicted in its extended, ready to use, condition in FIG. 1 and in its collapsed, easily transportable, storage, condition in FIG. 4.

Figure 3:
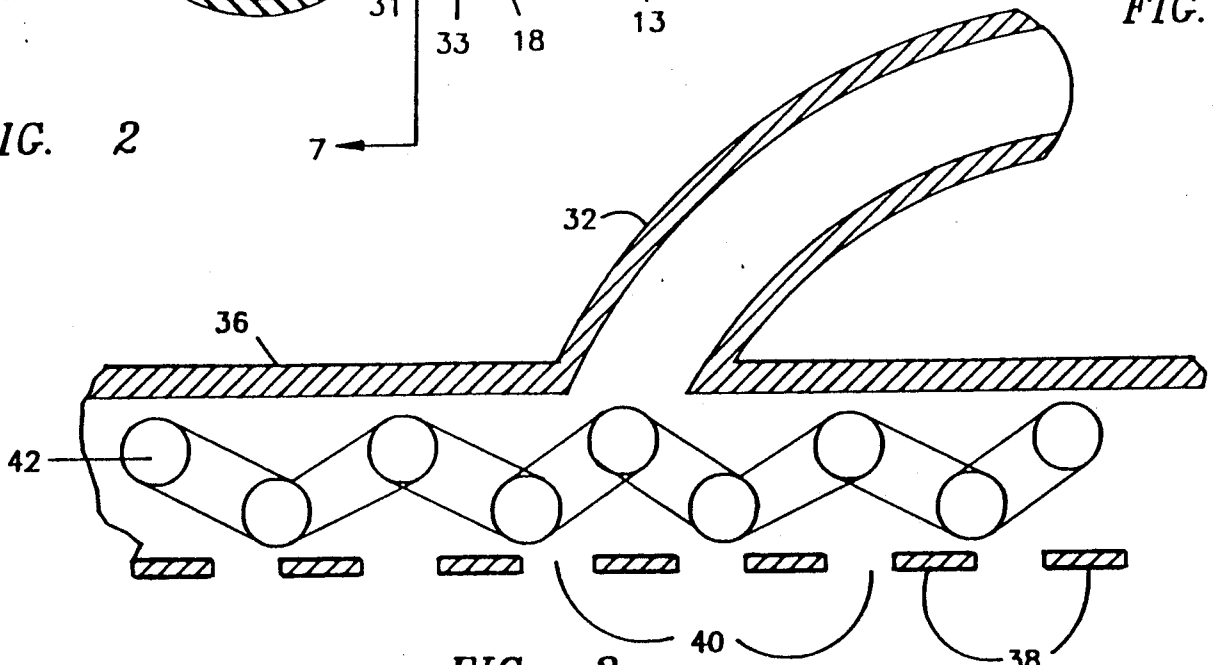
FIG. 3 is a sectional view along line 3—3 of FIG. 1.

As best illustrated in FIG. 1, portable shower apparatus 10 includes a curtain assembly 12 which defines a chamber 14, a series of spaced hollow hoops 16, a plurality of nozzles 18 connected to and in communication with hoops 16, a plurality of aligned, flexible, longitudinal hollow tubes 26, which constitute a manifold, connected to and in communication with adjacent hoops 16, a flexible supply pipe 28 connected to and in communication with the uppermost of hoops 16, a first fluid discharge hose 30 in communication with a drain 47 in floor or bottom 46 of chamber 14, a second fluid discharge hose 32 in communication with chamber 14, and a collection hose 34 connected to and in communication with first fluid discharge hose 30 and second fluid discharge hose 32. Referring now to FIG. 3, curtain assembly 12 includes a generally cylindrical outer wall 36 connected to and in communication with second fluid discharge hose 32, an inner wall 38 having a plurality of perforations 40 therein opening into chamber 14, a porous element 42 such as a nylon mesh or a series of nylon balls between outer wall 36 and inner wall 38 for separating and preventing contact of inner wall 38 with outer wall 36. FIG. 1 shows curtain assembly 12 as being made of a transparent material for reasons to be later explained with the inner wall 38 and porous element 42 removed therefrom for clarity. Referring now to FIG. 1, shower apparatus 10 further includes a floor or bottom 46 secured to outer and inner walls 36 and 38 and connected to and in communication with first fluid discharge hose 30, a ceiling or top 48 secured to outer and inner walls 36 and 38, a longitudinal opening (not shown) in outer and inner walls 36 and 38, and a zipper 50 secured to outer and inner walls 36 and 38 adjacent the opening (not shown) in walls 36 and 38 for closing the opening.

Referring now to FIG. 1, flexible supply pipe 28 is adapted to be connected to, and communicate with a source 52 of fluid under pressure; hose 34 is adapted to be connected to and communicate with suction pump 54; and a pressure differential control device 56 is adapted for connection to suction pump 54 and the interior of chamber 14 to maintain pressure within chamber 14 while allowing suction pump 54 to draw or suck fluid from chamber 14 through first and second discharge hoses 30 and 32. The source 52 of fluid under pressure may be any conventional mechanism such as a pump or compressor in combination with a supply of water, or other liquid, which causes the water or other liquid to be mixed with air and forced through supply pipe 28 into hoops 16, tubes 26 and nozzles 18. The suction pump 54 may be any conventional mechanism capable of sucking or withdrawing fog or vapor (which includes a liquid) from chamber 14 through first and second discharge hoses 30 and 32. The pressure differential control device 56 may be any conventional device capable of maintaining pressure within chamber 14 while still allowing suction pump 52 to remove fog or vapor (including a liquid) from chamber 14. The pressure differential control device 56 will either increase the output of source (pump) 52 to provide more fluid pressure if there is a drop in fluid pressure or cause suction pump 54 to withdraw more fluid from chamber 14 if fluid pressure becomes excessive.

In the embodiment of the invention as depicted in FIGS. 1–4 and 7, the outer wall 36, the inner wall 38 and the porous separation element 42 would normally be made of a transparent material such as a conventional high quality, thick, plastic for reasons to be explained later. The embodiment of the invention depicted in FIGS. 1–4 and 7 would primarily be used to rinse harmful chemicals or the like from a person who has been contaminated. While initially intended for use on a Space Station, it could be used in laboratories and factories on earth as well as for routine shower bathing almost anywhere, but especially in areas with limited water supply. The embodiment of FIGS. 1–4 and 7 could likewise be used to treat persons with severe medical problems such as burns to the body. When used to treat persons with severe medical problems such as burns to the body a suitable drug in the form of a fluid would be provided to and dispensed by nozzles 18 which are individually controlled by one or more persons located outside of shower apparatus 10. The transparency of the outer wall 36, the inner wall 38 and the porous separation element 42 allows the person outside of shower apparatus 10 to see the person within shower apparatus 10.

Figure 2:
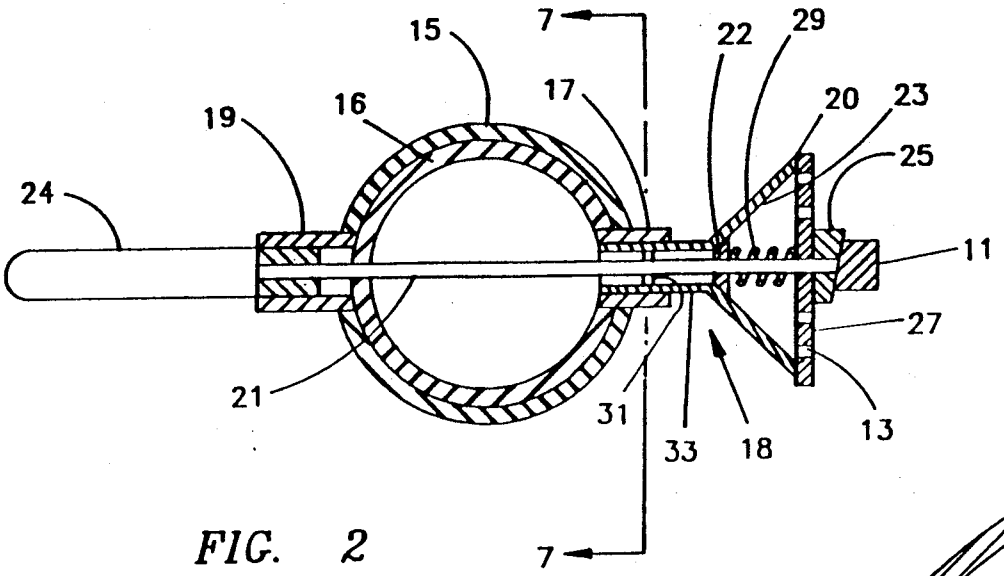
FIG. 2 is a sectional view along line 2—2 of FIG. 1, illustrating some of the elements not shown in FIG. 1, but not showing the inner and outer walls and the separation element.

In the embodiment illustrated in FIGS. 1–4 and 7, each nozzle 18, as best shown in FIG. 2, includes a nozzle head 20 having numerous small openings 13 and a knob 11 which protrudes into chamber 14, a handle 24 which protrudes out of outer wall 36 of curtain assembly 12, and a valve 22 capable of being actuated by either handle 24 or knob 11. As illustrated in FIG. 2, a casing 15 is placed around each hoop 16 adjacent each nozzle 18 to help support the nozzle 18 and its associated valve 22 and handle 24. Each casing 15 includes a first annular extension 19 and a second annular extension 17 diametrically opposed to the first annular extension 19. As shown, valve 22 is trapezoid shaped and mounted on a slidable and rotatable rod 21 whose ends are secured to knob 11 and handle 24. The tapered outer surface of valve 22 corresponds to the tapered inner surface 23 of nozzle 18 so that they can mate to close the valve 22 and prevent fluid from reaching small openings 13 in nozzle 18. A cam member 25 surrounds rod 21 and is secured to the face 27 of nozzle 18 for holding valve 22 in its opened position. A spring 29 surrounds rod 21 for acting between nozzle 20 and valve 22 to normally urge valve 22 so that it seats within tapered surface 23 of nozzle 18. Spring urged detents and spaced openings or other suitable means might be provided in the mating surfaces of knob 11 and cam member 25 to lock valve 22 (against the urging action of spring 29) in one or more opened positions. A spider like structure 31 (FIGS. 2 and 7) is secured within an extension 33 of nozzle 18 for supporting the rod 21. Valve 22 can be opened or closed either from inside of chamber 14 or outside outer wall 36 by either pushing on and rotating handle 24 or by turning knob 11 to open the valve 22 or by rotating and pulling on handle 24 or turning knob 11 to close valve 22.

Figure 4:
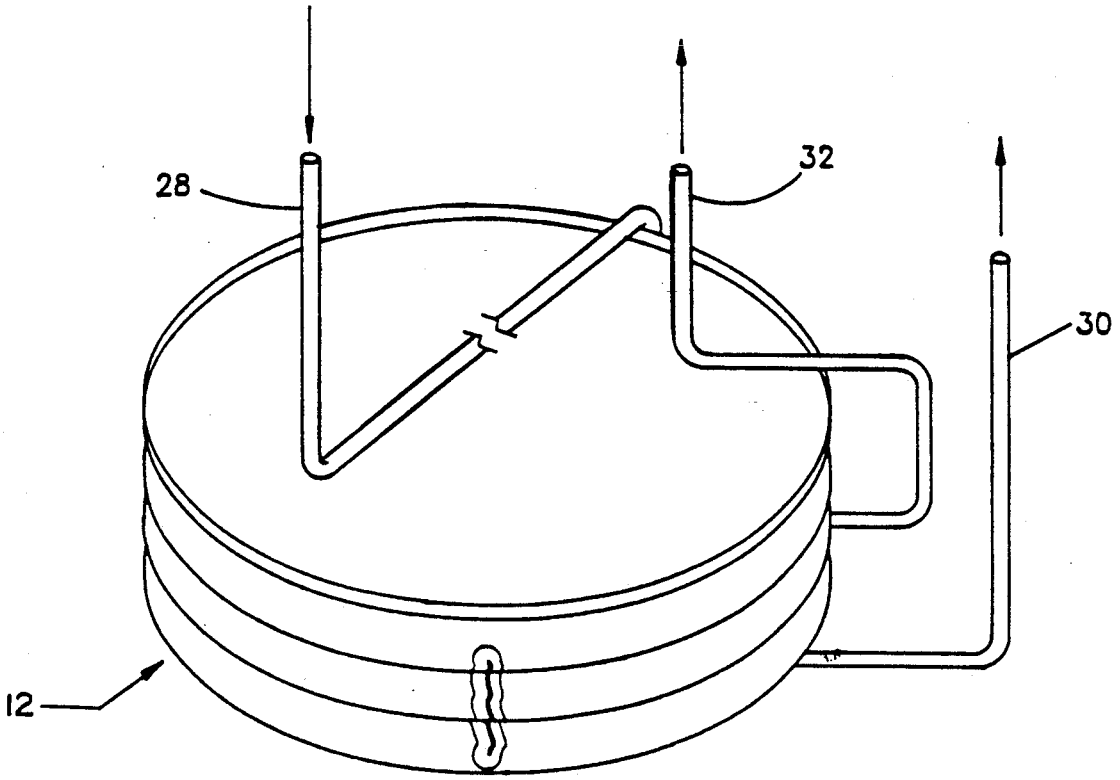
FIG. 4 is a partially broken away, perspective view, of the portable shower apparatus shown in FIGS. 1-3 in a generally collapsed storage condition.

The operation of the embodiment depicted in FIGS. 1–4 and 7 is as follows. While in the collapsed condition as shown in FIG. 4, but with source 52 connected to supply pipe 28, suction pump 54 being connected to hose 34, and pressure differential control device 56 being connected to curtain assembly 12 and to suction pump 54 as generally shown in FIG. 1, a fluid (e.g., a mixture of air and water) is released from source 52, through flexible supply pipe 28, to hollow hoops 16 and connecting hollow, flexible, tubes (manifold) 26, thus pressurizing the network of hoops 16 and tubes 26, which causes curtain assembly 12 to open from its collapsed condition as generally shown in FIG. 4 to its fully extended condition and be maintained in such condition as shown in FIG. 1. It is apparent that additional manifolds made up of aligned flexible tubes 26 could be incorporated in shower apparatus 10 at spaced intervals to enable shower apparatus 10 to be more easily raised from its collapsed condition (FIG. 4) to its extended condition (FIG. 1) and maintained in its fully extended condition. A person (the victim of contamination) would then enter the chamber 14 through the zippered opening by manipulation of zipper 50. Chamber 14 is then closed by manipulation of zipper 50 by either the person inside of chamber 14 or by a person located outside of curtain assembly 12. The person within chamber 14 or one or more persons outside of curtain assembly 12 can selectively manipulate via knob 13 or handle 24 as explained above to create a fog like spray or mist that scrub contaminants from the person within chamber 14. Wastewater and the like leaves the chamber 14 through perforations 40 in inner wall 38 and first fluid discharge hose 30 and second fluid discharge hose 32 due to the suction created by suction pump 54.

Figure 5:
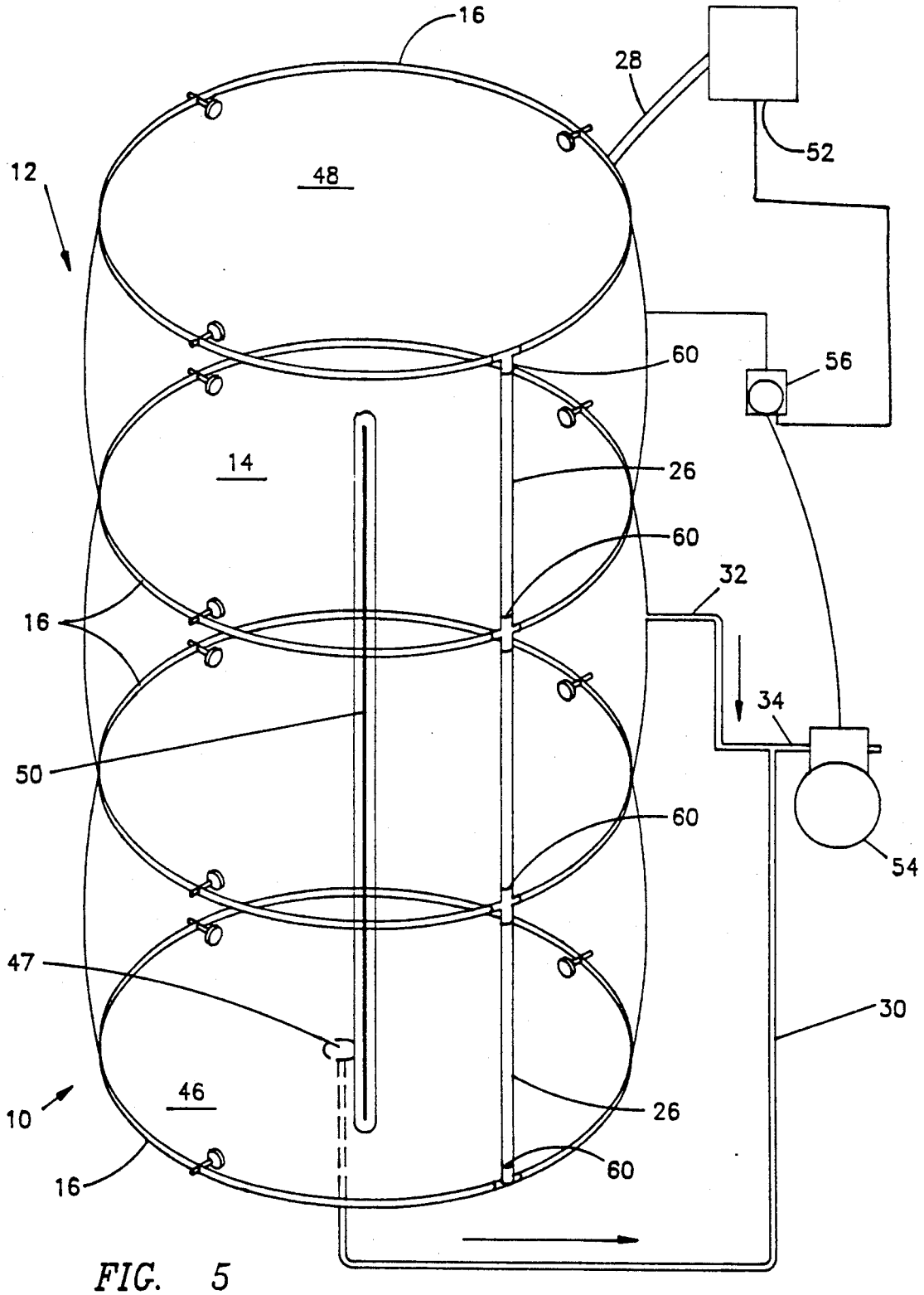
FIG. 5 is a perspective view of a second embodiment of the portable shower apparatus of the present invention in an upright, extended, condition, but not showing several elements for clarity purposes.

The embodiment of the invention depicted in FIG. 5 differs from that shown in FIGS. 1–4 only by the addition of conventional two way valves 60 at the junction of each hoop 16 with longitudinal tubes (manifold) 26. The two way valves 60 in one position allow the fluid under pressure to enter tube (manifold) 26 to pressurize the network of hoops 16 and tube 26 to open curtain assembly 12 from its collapsed condition to its extended condition. The two way valves 60 in a second position allow the fluid under pressure to enter a selected hoop 16 to allow the fluid to flow through the selected hoop 16 to allow the fluid to be dispensed from the nozzles 18 associated with the selected hoop 16. The structure of the embodiment shown in FIG. 5 permits fluid to be available only to selected ones of the several hoops 16. For example, with this embodiment, fluid could be provided only to the uppermost hoop 16, to the two uppermost hoops 16, to the uppermost and third uppermost hoops 16 or whatever. If more than one manifold (sets of aligned, flexible, tubes 26) is incorporated in shower apparatus 10 to enable better erection to and maintenance in its fully extended condition as indicated above, it is apparent that only one two-way valve would be required with respect to each hoop 16.

Figure 6:
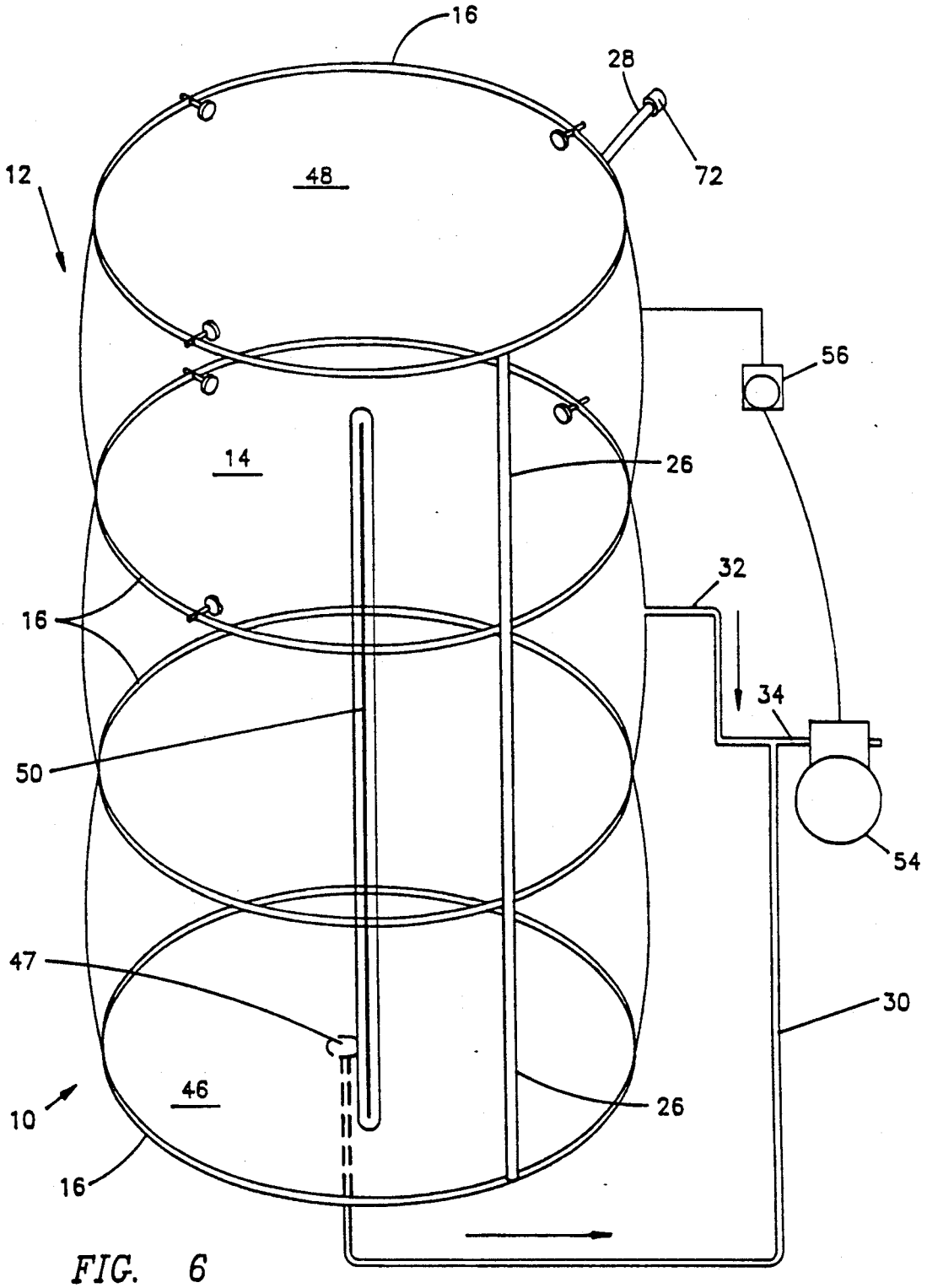
FIG. 6 is a perspective view of a third embodiment of the portable shower apparatus of the present invention in an upright, extended, condition, but not showing several elements for clarity purposes.

The embodiment of the invention depicted in FIG. 6 differs from that shown in FIGS. 1–4 only by the elimination of nozzles from all but the uppermost or two uppermost hoops 16 and having a conventional water hose connection 72 to supply pipe 28 for feeding water only to the nozzles 18 on a selective basis. With the embodiment depicted in FIG. 6, the pressure of the water will cause hoops 16 and tube 26 to be pressurized to cause the curtain assembly to be held and maintained in an upright, erected, condition. With this embodiment, more water would be required than in the other embodiments. With this embodiment, the second fluid discharge hose 32 might be eliminated.

While the drawings depict the outer wall 36 and inner wall 38 of curtain assembly 12 as being made of transparent plastic material, such walls can be made of materials other than plastic and be opaque rather than transparent. The transparent material, rather than opaque material, is preferred primarily where the nozzles 18 may likely be operated by someone located outside of shower apparatus 10 and shower apparatus is being used for decontamination or medical treatment purposes.

While the above description constitutes preferred embodiments of the present invention, it will be appreciated that the invention is susceptible to modification, variation and change without departing from the proper scope and fair meaning of the accompanying claims. For examples: the shape or configuration of curtain assembly 12 and hoops 16 need not be generally round as depicted in the drawings as they could be rectangular or some other shape or configuration, they could even be in the form of a jump suit or bag for medical treatment purposes; only a single nozzle 18 could be incorporated in the uppermost hoop 16; twelve volt batteries or A/C outlets could be utilized as the power source; other type of spray devices, including conventional nozzle heads, could be substituted for nozzles 18; and a conventional valve could be placed at the junction of supply hose 28 with the uppermost hoop 16.

I claim:

1. A portable shower apparatus comprising:

a flexible chamber comprised of an outer wall, an inner wall and a floor;

means associated with said chamber for providing ingress to and egress from said chamber;

a plurality of spaced apart support means for receiving fluid and for supporting said chamber;

at least one set of a plurality of flexible hollow tubes, each tube being connected between and in communication with adjacent ones of said support means for supporting said chamber when fluid is received therein;

at least one nozzle connected to and in communication with at least one of said fluid receiving support means;

a supply hose connected to and in communication with one of said fluid receiving support means;

a source of fluid under pressure in communication with said supply hose for allowing said fluid under pressure to be dispensed from said at least one nozzle;

a first discharge hose in communication with the interior of said chamber; and means in communication with said first discharge hose for withdrawing said fluid from the interior of said chamber.

2. The portable shower apparatus of claim 1 wherein said flexible chamber includes means disposed between said inner and outer walls for holding and maintaining said walls in a spaced, nonengaging, relationship.

3. The portable shower apparatus of claim 2 wherein said inner wall of said chamber includes a plurality of perforations therein.

4. The portable shower apparatus of claim 3 wherein said means for holding and maintaining said inner and outer walls of said chamber in a spaced, nonengaging, relationship is formed of a flexible, porous, material.

5. The portable shower apparatus of claim 4 wherein said means for providing ingress and egress from said chamber includes a zipper secured in a longitudinal opening in each of said inner and outer walls.

6. The portable shower apparatus of claim 5 wherein said fluid comprises a mixture of air and water for producing a fog to be dispensed from said nozzles.

7. The portable shower apparatus of claim 6 including a second discharge hose in communication with the interior of said chamber and said means for withdrawing said fluid from said chamber.

8. The portable shower apparatus of claim 7 wherein said means for withdrawing said fluid from said chamber includes a suction apparatus.

9. The portable shower apparatus of claim 8 wherein said outer wall of said chamber is formed of opaque flexible material.

10. The portable shower apparatus of claim 9 wherein said chamber includes a ceiling secured to said inner and outer walls and said plurality of fluid receiving support means includes a plurality of hollow hoops.

11. The portable shower apparatus of claim 7 wherein a plurality of nozzles are connected to and in communication with each of said fluid receiving support means.

12. The portable shower apparatus of claim 11 wherein each of said nozzles has valve means associated therewith for the selective and discrete dispensing of said fluid therefrom, said valve means being disposed for actuation both from within and outside of said chamber.

13. The portable shower apparatus of claim 12 wherein each of said inner and outer walls and said flexible, porous, material of said chamber is formed of a transparent material.

14. A portable shower apparatus comprising:

a flexible chamber comprised of an outer wall, an inner wall having a plurality of perforations therein, a floor having a drain opening therein, and means disposed between said inner and outer walls for holding and maintaining said walls in a spaced, nonengaging, relationship;

means associated with said chamber for providing ingress to and egress from said chamber;

a plurality of hollow, vertically spaced apart, hoops secured to said inner wall of said chamber;

at least one set of a plurality of hollow tubes, connected between and in communication with said hollow hoops;

at least one nozzle connected to and in communication with at least one of said hollow hoops;

a supply hose connected to and in communication with the uppermost one of said hollow hoops;

a source of fluid under pressure in communication with said supply hose;

valve means in communication with at least one of said hoops for allowing said fluid under pressure to be dispensed from at least one of said nozzles;

a first discharge hose in communication with said drain opening in said floor of said chamber; and suction means in communication with said first discharge hose for withdrawing said fluid from the interior of said chamber.

15. The portable shower apparatus of claim 14 wherein said means for holding and maintaining said inner and outer walls of said chamber in a spaced, non-engaging, relationship is formed of a flexible, porous, material.

16. The portable shower apparatus of claim 15 wherein said fluid comprises a mixture of air and water for producing a fog to be dispensed from said nozzles.

17. The portable shower apparatus of claim 16 including a second discharge hose in communication with said inner and outer walls of said chamber and said suction means and wherein said chamber includes a ceiling secured to said inner and outer walls.

18. The portable shower apparatus of claim 17 wherein said outer wall of said chamber is formed of opaque flexible material.

19. The portable shower apparatus of claim 17 wherein a plurality of nozzles are connected to and in communication with each of said hollow hoops and wherein each of said nozzles has valve means associated therewith for the selective and discrete dispensing of said fluid therefrom.

20. The portable shower apparatus of claim 19 wherein each of said inner and outer walls and said flexible, porous, material of said chamber is formed of a transparent material.

* * * * *